United States Patent [19]

Hoffman

[11] Patent Number: 4,759,468

[45] Date of Patent: Jul. 26, 1988

[54] DISPENSING MECHANISM

[75] Inventor: Arlan Hoffman, Mantua, Ohio

[73] Assignee: Tachi S Co., Ltd., Tokyo, Japan

[21] Appl. No.: 74,150

[22] Filed: Jul. 16, 1987

[51] Int. Cl.[4] ..... B65H 3/44; G07F 11/22

[52] U.S. Cl. ..... 221/20; 221/117; 221/128; 221/131

[58] Field of Search ..... 221/20, 93, 95, 112, 221/117, 128, 131, 151–152

[56] References Cited

U.S. PATENT DOCUMENTS

| | | | |
|---|---|---|---|
| 730,624 | 6/1903 | Elliott | 221/20 |
| 1,461,417 | 7/1923 | Giles | 221/20 X |
| 3,970,181 | 7/1976 | Rubio | 194/237 |

FOREIGN PATENT DOCUMENTS

| | | | |
|---|---|---|---|
| 682614 | 2/1965 | Italy | 221/117 |

*Primary Examiner*—Charles A. Marmor

*Attorney, Agent, or Firm*—Oldham, Oldham & Weber Co.

[57] ABSTRACT

A double-acting, vending machine dispensing mechanism is shown whereby product units are alternately dispensed from adjacent storage compartments by an ejection device. The ejection device comprises a horizontally reciprocating dispensing bar connected to, and moved by the pendular movement of a rocker frame, motion of the latter being induced by the camming action of a gear mounted boss. The camming gear, in turn, is driven by a separate gear attached to the operating handle of a coin released mechanism.

10 Claims, 2 Drawing Sheets

DISPENSING MECHANISM

TECHNICAL FIELD

This invention relates to a double-acting dispensing mechanism. More particularly, this invention relates to a coin-operated dispensing mechanism used in vending machines. Specifically, the invention relates to double-acting dispensing mechanisms designed to dispense merchandise alternately from each of adjacent storage compartments in a vending machine. The dispensing action is accomplished by the reciprocating action of a sliding block member whose movement is induced by the pendular motion of a frame structure driven by a cam mounted on a gear indirectly connected to the mechanism's operating handle.

BACKGROUND OF THE INVENTION

Vending machines designed to vend a single type of merchandise have long been popular, particularly where the article vended has achieved a high volume of sales. In such situations, there is a need to provide sizeable storage capacity in the vending machine to minimize the intervals between visits to the machine by a service person, and thus reduce operating costs. Commonly, articles vended from a machine are dispensed by gravity, favoring their disposition in vertical stacks, one on top of another. The storage capacity limitation imposed by height constraints has led the vending machine industry to resort to "double-acting" vending mechanisms in which identical articles are stored in vertical stacks in adjacent compartments, the articles alternately being dispensed from each.

Such a device is shown in U.S. Pat. No. 3,970,181, in which a dispensing foot is moved back and forth in a pendular arc between adjacent compartments, ejecting merchandise in turn from each in the vending process. In the machine, the foot moves through a relatively wide gap provided in the support members forming the shelf on which the articles to be vended rest, enabling the foot to contact the edge of the articles and push them from the device. Unfortunately, the sizeable gap between the support members required to accomodate access by the foot makes it difficult, or in some cases impossible, to vend products narrower than the gap. This seriously limits the versatility, and therefore, the usefulness of the machine.

Furthermore, when a pendulum structure is directly used as a means by which articles are dispensed from adjacent compartments in a double-acting vending machine, dispensing of the merchandise must necessarily occur in two, opposite directions. This necessitates provision for ejection space at each side of the machine, requiring relatively wide machines, which in some cases are undesirable.

In addition, the machine taught in the patent referred to requires a direct connection between the cam which actuates the pendulum structure, and the operating handle of the machine. Such a connection undesirably limits the ease with which the mechanism can be operated.

DISCLOSURE OF THE INVENTION

In light of the foregoing, therefore, a first aspect of the invention disclosed herein is to provide a double-acting dispensing mechanism capable of vending merchandise from adjacent product storage compartments.

A second aspect of the invention is to provide a gear driven dispensing mechanism capable of smooth interaction, allowing operation with minimal effort.

Another aspect of this invention is the provision of a vending machine mechanism which is adapted to vend product packages of varying widths, including narrow packages.

A further aspect of this invention is to furnish a double-acting dispensing mechanism which employs a pendulum structure only indirectly in the dispensing process, thereby permitting modification of the mechanism to allow either of two operating modes, i.e., articles can be dispensed from the vending machine alternately in opposite directions, or if desired, in a single direction.

An additional aspect of the invention is to provide a vending machine dispensing mechanism capable of use with a variety of coin-operated actuating devices.

The foregoing and other aspects of the invention are provided by a double-acting, dispensing mechanism comprising:

a product-unit storage bin;

a product-unit dispensing means, and a product-unit discharge actuator, said bin comprising at least two adjacent, vertical, storage compartments in which said product-units are stored, the front and rear walls of said compartments extending lower than the sidewalls thereof and being fitted with a platform on which said product-units are supported, sufficient vertical clearance being provided between the lower edge of said sidewalls and said platform for the product-units being dispensed to pass therebetween, with each of said front and rear walls being furnished with a horizontal slot located at a level between the lower edge of said sidewalls and said platform, wherein said dispensing means comprises a U-shaped frame, together with a horizontal bar, each side of said frame having a vertical slot therein, said frame being pivotally attached to the front and rear walls of said compartments, and said bar being slidably supported adjacent said platform and fitted at each end with a boss which extends into the lower end of said vertical slot adjacent thereto, and wherein said product-unit discharge actuator comprises at least two meshing gears, a first of which includes a boss adjacent to the periphery thereof which extends into the upper end of one of said vertical slots, and the second of which is connected to the operating handle of said dispensing mechanism.

The foregoing and other aspects of the invention are also attained by a vending machine which includes a double-acting dispensing mechanism comprising:

a product-unit storage bin;

product-unit dispensing means, and a product-unit discharge actuator, said bin comprising two adjacent, vertical, quadrilateral storage compartments in which said product-units are vertically stacked, the front and rear walls of said compartments extending lower than the sidewalls thereof and being fitted with a platform on which said product-units are supported, sufficient vertical clearance being provided between the lower edge of said sidewalls and said platform for the product-units being dispensed to pass therebetween, with each of said front and rear walls being furnished with a horizontal slot located at a level between the lower edge of said sidewalls and said platform, wherein said dispensing means comprises a U-shaped frame, together with a horizontal bar, each side of said frame having a vertical slot therein, said frame being pivotally attached to the front and rear walls of said compartments, and said bar being slideably supported adjacent said platform and fitted at each end with a boss which extends into the lower end of said vertical slot adjacent thereto, and wherein said product discharge actuator comprises two meshing gears, a first of which includes a boss adjacent to the periphery thereof which extends into the upper end of one of said vertical slots, and the second of which is connected to the rotatable, operating handle of said dispensing mechanism, said handle being inoperative until predetermined coins have been inserted into said vending machine.

BRIEF DESCRIPTION OF THE DRAWINGS

The invention will be better understood when reference is had to the following drawings, in which like numbers refer to like parts, and in which.

BEST MODE FOR CARRYING OUT THE INVENTION

Figure 1:
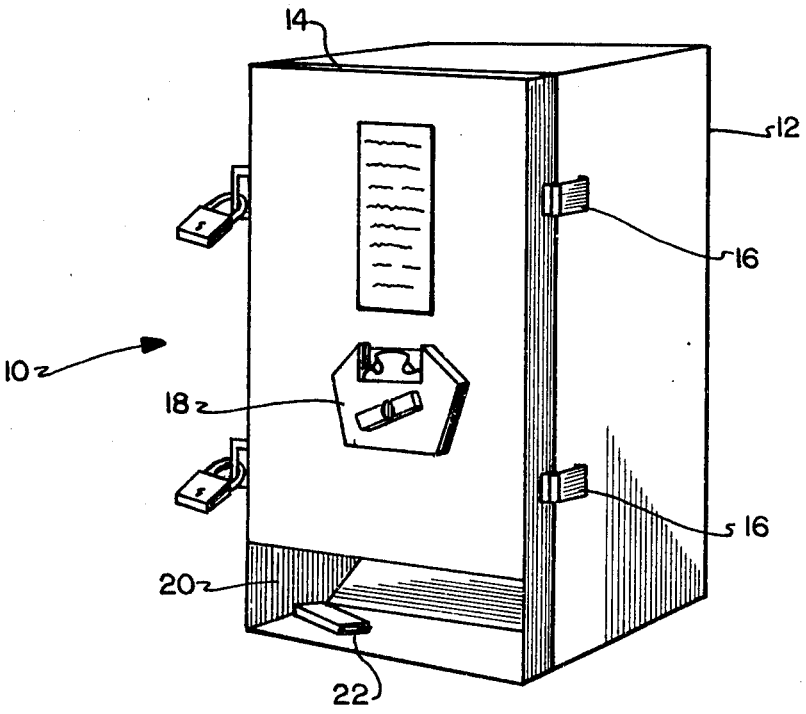
FIG. 1 is an isometric view of a vending machine of a type contemplated by the invention.

FIG. 1 shows an isometric view of a vending machine, generally 10, comprising a case 12 to which a front access door 14 has been attached and locked by means of locking bars 16. Vending machine 10 has a coin mechanism 18, which when the proper coins have been inserted may be rotated, releasing the vended product-unit into dispensing chute 20. Machines of the type shown in FIG. 1 are particularly useful where the vending of personal products is intended, for example, the vending of condoms, personal hygiene products, and the like, which are commonly sold in public restrooms.

Figure 2:
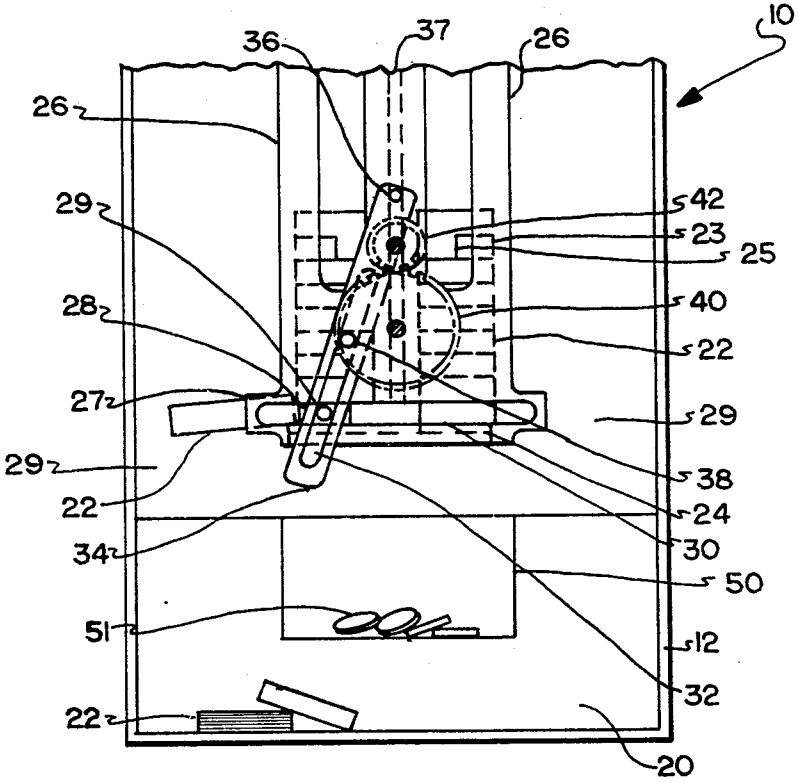
FIG. 2 is a front section of the dispensing mechanism shown in FIG. 3, along line 2—2 of the latter Figure.
Figure 3:
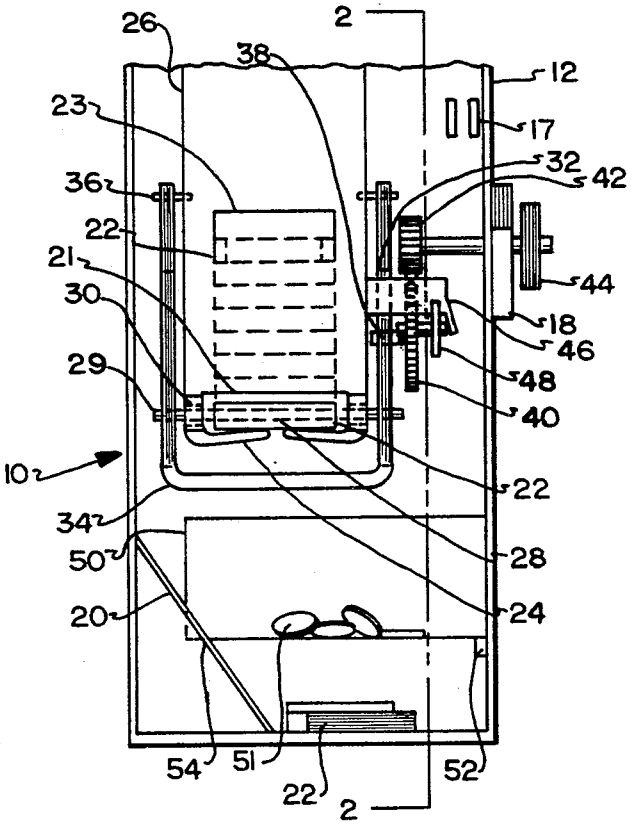
FIG. 3 is a side elevation of the vending machine of FIG. 1 in which the side of the case has been removed.

FIG. 2 shows a front section of the dispensing mechanism of the invention along the line 2—2 of FIG. 3. The Figure shows the case 12 of the machine, including the coin box 50, and included coins 51. Also illustrated are the vended product-units 22, stored on top of one another in vertical columns in the product-unit storage compartments 26. A product-unit dispensing bar 28 is located in a horizontal bar slot 30. The dispensing bar 28 is provided with a dispensing bar boss 29 at either end thereof, the boss extending into the vertical slot 32 of rocker frame 34. The rocker frame slot 32 also has a gear boss 38 of rocker frame gear 40 inserted thereon. As can be seen in the Figure, rocker frame gear 40 is intermeshed with the actuating handle gear 42, both gears being mounted so that their centers as well as the rocker frame pivot attachment point 36, are substantially in line with the juncture 37 of product-unit storage compartments 26. Disposed on top of product-units 22 are weights 23, which assist in feeding the units onto support rails 24 in preparation for their subsequent dispensing, for example, at point 27 where they are ejected from one of the product-unit storage compartments, falling into dispensing chute 20, at which point they are accessible to the purchasers.

In the vending process, proper coins are inserted into the coin mechanism controlling the operation of the actuating handle responsible for rotation of actuating handle gear 42. As the handle is moved, the gear 42 rotates, also rotating the rocker frame gear 40 with which it meshes. As the latter gear turns, it exerts a camming action on rocker frame 34 by virtue of the force which the gear boss 38 attached to gear 40 exerts on the rocker frame vertical slot 32. In the Figure, the camming action results in rocker frame 34 being forced to the left, which also moves dispensing bar 28 to the left as a result of the force imposed by rocker frame vertical slot 32 on the dispensing bar boss 29 inserted therein. As the dispensing bar 28 moves to the left, it contacts the edge of the product-unit package 22, shown being ejected at dispensing point 27, pushing the product-unit out of its storage compartment where it falls into the dispensing chute 20. Further rotation of actuating handle gear 42 causes rocker frame 34 to pivot to the right, reversing the process described, and resulting in dispensing of a product-unit 22 from the other chute 26.

While different ratios of diameters may be employed for gears 40 and 42, for instance, respectively, one to one, two to one (illustrated), or others, the use of the latter ratio is especially preferred, since among other things, it allows a full revolution of the actuating handle attached to gear 42 to accomplish dispensng of a product-unit. Furthermore, a gear ratio of two to one, gear 40 to gear 42, provides a mechanical advantage for the purchaser, facilitating the ease of which the mechanism can be used, not only because of the operating smoothness produced by the mechanism's gear drive, but also because of the mechanical advantage resulting from such ratio. Furthermore, the use of a gear train not only makes a smooth, effortless movement of the mechanism possible, but allows the coin mechanism to be easily replaced, it only being necessary to provide a gear of the appropriate type on the end of the substitute coin mechanism. Although the Figure illustrates a gear train consisting of two gears, if desired, additional gears can be introduced into the gear train to accomplish the degree, and direction of movement desired.

As illustrated in the Figure, the dispensing mechanism shown allows the ejection of product-units 22 from both sides of the mechanism, in alternating sequence. The conversion of the pendular movement of rocker frame 34 to the horizontal, sliding action of dispensing bar 28 can by suitable alteration of the dispensing mechanism make possible the ejection of product-units 22 in one direction only. This mode of operation can be obtained by the temporary support of product-units 22, for example, in the right-hand storage compartment 26, above the level at which they can be contacted by dispensing bar 28. Simultaneously with the ejection of the last product-unit in the lefthand storage compartment, such support is removed, allowing the gravity feed of product-units 22 from the right-hand storage compartment to be ejected. The unidirectional ejection concept requires modifications beyond that of the temporary isolating product-unit support referred to, but it well within the capability of those skilled in the art, given the reciprocating, horizontal action of the dispensing bar 28.

Unidirectional dispensing provides the inherent advantage of allowing the width of the vending machine to be desirably reduced, since the single dispensing point requires provision of only a single disengagement area 29.

In FIG. 2, the supporting rails 24 are shown extending substantially from the outer sidewall of one product-unit storage compartment 26 to the outer sidewall of the other such storage compartment. Product-unit support provided by rails of such length, although not necessary, helps circumvent the unauthorized dispensing of product-units, which might otherwise be achieved in the case of shorter rails by a product-unit dislodging blow applied to the side of the case 12.

A further advantage of the mechanism of the invention lies in its use in connection with product-unit weights 23. In FIG. 2, "L"-shaped weights which include of a horizontal portion and a vertical portion are shown. As the last product-unit package 22 in one of the storage compartments 26 is dispensed, the vertical portion of the weight drops across the horizontal path of dispensing bar 28, preventing subsequent movement of the bar, thereby blocking the mechanism and preventing further acceptance of coins as a consequence of the machine's substantially empty condition. Such result avoids the frustration of users who fail to receive product after parting with their money, a frustration which frequently causes such users to deliberately damage the vending machine. While an L-shaped weight 23 has been illustrated, it will be appreciated that any weight with a horizontal portion, in combination with a blocking vertical portion, for example a downwardly extending pin or other projection, would be suitable for the purpose described.

FIG. 3 is a side elevation of the vending machine 10 of FIG. 1 in which the left-hand side 12 of the case has been removed. In the Figure, product-units 22, with a weight 23 resting thereon, are shown stacked in a vertical column, the lowest of the product-units resting on support rails 24, formed in the case of the machine of the Figure by bending the lower edge of the front and rear walls of product-unit storage compartments 26 inwardly. A rocker frame 34 is attached to the storage compartments 26 at rocker-frame pivot point 36. The dispensing bar bosses 29 extending from dispensing bar 28 extend through the rocker frame vertical slots 32, while the dispensing bar itself rests within bar slot 30. Also shown in the Figure are rocker frame gear 40, with its attached gear boss 38, extending through rocker frame slot 32. Rocker frame gear 40 intermeshes with actuating handle gear 42, in turn attached to operating handle 44 of the coin mechanism 18. Apertures 17 for locking bar 16 are shown, as is coin box 50, containing coins 51. Coin box 50 is supported by box support recess 54 in dispensing chute 20, and by box support member 52 at the front of the vending machine. Vended product-units 22 are indicated at the bottom of the machine, at the place where they are accessible to the purchaser.

In FIG. 3, rails 24 are formed into a platform by bending the lower edge of the front and rear walls of storage compartment 26 inwardly. In addition, the end of the rails 24 are shown substantially meeting at the center of the storage compartment 26, a preferred structure, since it permits even the smallest packages to be dispensed without risk of having them fall through the space between the rails. Alternatively, members connected to the sidewalls of the storage compartments 26 and projecting inwardly from each wall, could be substituted for the bent construction shown. Similarly, a continuous, horizontal plate or platform could extend across the space between the front and rear walls of storage compartments 26 to serve as the supporting structure for the of the product-units 22. Space 21 provided between the lower edge of the sidewalls of storage compartment 26 and the rails 24 is designed to be large enough for a single product-unit package 22 to pass therebetween in the process of being dispensed. If desired, provision for a vertical adjustment plate, not shown, which can be raised or lowered to adjust the height of space 21 can be provided so that the vending machine can be altered to accomodate whatever product-unit package height is to be vended. The dispensing bar 28 normally takes the shape of the rectangular plate shown, although other forms, for instance, a rod, or other structure suitable for the purposes intended can be used. The height of the dispensing bar 29 may be altered over a fairly broad range, as may be the other dimensions, it only being necessary that it be capable of slidably ejecting the product-unit packages 22 through space 21.

While two product-unit storage compartments 26 are shown disposed transversely side-by-side, it is also within the scope of the invention to provide more than two compartments transversely in line with each other, or to provide a structure in which two transversely connected compartments may be longitudinally attached to identical transversely connected compartments. Where structures of the latter type are provided, the rocker frame 34 and dispensing bar 28 would need to be widened to encompass the end-to-end connected, transverse structures, permitting the dispensing of two product-unit packages 22 simultaneously. Other modifications within the scope and spirit of the invention will readily occur to the practitioner.

While in accordance with the patent statutes, a preferred embodiment and best mode has been presented, the scope of the invention is not limited thereto, but rather is measured by the scope of the attached claims.

What is claimed is:

1. A double-acting dispensing mechanism comprising:

a product-unit storage bin;

a product-unit dispensing means, and a product-unit discharge actuator, said storage bin comprising at least two adjacent, vertical, storage compartments in which said product-units are stored, the front and rear walls of said compartments extending lower than the sidewalls thereof and being fitted with a platform on which said product-units are supported, sufficient vertical clearance being provided between the lower edge of said sidewalls and said platform for the product-units being dispensed passed therebetween, with each of said front and rear walls being furnished with a horizontal slot located at a level between the lower edge of said sidewalls and said platform, wherein said dispensing means comprises a U-shaped frame, together with a horizontal bar, each side of said frame having a vertical slot therein, said frame being pivotally attached to the front and rear walls of said compartments, and said bar being slidably supported adjacent said platform and fitted at each end with a boss which extends into the lower end of said vertical slot adjacent thereto, and wherein said product-unit discharge actuator comprises at least two meshing gears, a first of which includes a boss adjacent to the periphery thereof which extends into the upper end of one of said vertical slots, and the second of which is connected to the operating handle of said dispensing mechanism.

2. A dispensing mechanism according to claim 1 in which said platform comprises inward projections that form rails on which said product-units are supported.

3. A dispensing mechanism according to claim 1 in which the point of pivotal attachment and the centers of said first and second gears are located substantially in line with the juncture of said compartments.

4. A dispensing mechanism according to claim 1 wherein two storage compartments are located side-by-side, and the boss of said first gear acts as a cam which interacts with one of said vertical slots, moving said frame in pendular fashion, thereby causing said horizontal bar to be driven back and forth in said horizontal slot, forcing the product-units from alternating storage compartments to slide along said platform, alternately toward each of the outer sidewalls of said compartments, far enough for said product units to be dispensed by gravity after falling off said platform.

5. A dispensing mechanism according to claim 1 in which said platform extends substantially from the outer sidewall of one compartment to the outer sidewall of the other compartment.

6. A dispensing mechanism according to claim 1 in which the diameter of said first gear is twice the diameter of said second gear.

7. A dispensing mechanism according to claim 1 in which a weight is placed on the top of said product-units in each of said compartments, said weight having a horizontal portion, and a downward vertical portion, said vertical portion interfering with the movement of said horizontal bar when the compartment within which said weight is placed is emptied of product-units, thereby rendering the mechanism inoperable.

8. A vending machine which includes a double-acting, dispensing mechanism comprising:

a product-unit storage bin;

a product-unit dispensing means, and a product-unit discharge actuator, said bin comprising two adjacent, vertical, quadrilateral storage compartments in which said product-units are vertically stacked, the front and rear walls of said compartments extending lower than the sidewalls thereof and being fitted with a platform on which said product-units are supported, sufficient vertical clearance being provided between the lower edge of said sidewalls and said platform for the product-units being dispensed to pass therebetween, with each of said front and rear walls being furnished with a horizontal slot located at a level between the lower edge of said sidewalls and said platform, wherein said dispensing means comprises a U-shaped frame, together with a horizontal bar, each side of said frame having a vertical slot therein, said frame being pivotally attached to the front and rear walls of said compartments, and said bar being slidably supported adjacent said platform and fitted at each end with a boss which extends into the lower end of said vertical slot adjacent thereto, and wherein said product discharge actuator comprises two meshing gears, a first of which includes a boss adjacent to the periphery thereof which extends into the upper end of one of said vertical slots, and the second of which is connected to the rotatable operating handle of said dispensing mechanism, said handle being inoperative until predetermined coins have been inserted into said vending machine.

9. A vending machine according to claim 8 in which said platform comprises inward projections that form rails on which said product-units are supported.

10. A vending machine according to claim 8 in which said platform is formed by bending the lower edge of the front and rear walls of said compartments inwardly.

* * * * *

UNITED STATES PATENT AND TRADEMARK OFFICE

CERTIFICATE OF CORRECTION

PATENT NO. : 4,759,468

DATED : July 26, 1988

INVENTOR(S) : Arlan Hoffman

It is certified that error appears in the above-identified patent and that said Letters Patent is hereby corrected as shown below:

On the title page, item 73, assignee reading "Tachi S Co., Ltd., Tokyo, Japan" should read -- Lester Garson, part interest, Cleveland, Ohio --.

Signed and Sealed this

Twentieth Day of August, 1991

*Attest:*

*Attesting Officer*

HARRY F. MANBECK, JR.

*Commissioner of Patents and Trademarks*